US010673137B1

(12) United States Patent
Herscovici et al.

(10) Patent No.: US 10,673,137 B1
(45) Date of Patent: Jun. 2, 2020

(54) MULTIBEAM ANTENNA THAT SPANS THE 360 DEGREES SPACE IN AZIMUTH

(71) Applicant: Government of the United States, as represented by the Secretary of the Air Force, Wright-Patterson AFB, OH (US)

(72) Inventors: Naftali Herscovici, Framingham, MA (US); Bradley A Kramer, Beavercreek, OH (US); Anatoliy Boryssenko, Belchertown, MA (US)

(73) Assignee: The Government of the United States as Represented by the Secretary of the Air Force, Wright-Patterson, OH (US)

( * ) Notice: Subject to any disclaimer, the term of this patent is extended or adjusted under 35 U.S.C. 154(b) by 43 days.

(21) Appl. No.: 16/059,931

(22) Filed: Aug. 9, 2018

Related U.S. Application Data

(60) Provisional application No. 62/671,878, filed on May 15, 2018.

(51) Int. Cl.

| | |
|---|---|
| ***H01Q 19/06*** | (2006.01) |
| ***H01Q 3/26*** | (2006.01) |
| ***H01Q 21/24*** | (2006.01) |

(52) U.S. Cl.
CPC ..... *H01Q 3/2658* (2013.01); *H01Q 19/062* (2013.01); *H01Q 21/245* (2013.01)

(58) Field of Classification Search
CPC .... H01Q 19/06; H01Q 19/062; H01Q 3/2658; H01Q 21/245
See application file for complete search history.

(56) References Cited

U.S. PATENT DOCUMENTS 3,754,270 A * 8/1973 Thies, Jr. ..... H01Q 21/0031 343/754
4,359,738 A * 11/1982 Lewis ..... H01Q 19/06 342/379
5,966,103 A * 10/1999 Pons ..... H01Q 25/008 343/753

OTHER PUBLICATIONS

Tuli Herscovici; Considerations in the Design of Parallel Plate Luneburg Beamformers and Cylindrical Arrays; Research—Mar. 2016.

* cited by examiner

*Primary Examiner* — Hoang V Nguyen
(74) *Attorney, Agent, or Firm* — AFMCLO/JAZ

(57) ABSTRACT

A low-profile electronically scanned phased arrays integrated multi-beam cylindrical array that can scan by connecting to one feed or multiple feeds at one time.

13 Claims, 3 Drawing Sheets

MULTIBEAM ANTENNA THAT SPANS THE 360 DEGREES SPACE IN AZIMUTH

Pursuant to 37 C.F.R. § 1.78(a)(4), this application claims the benefit of and priority to prior filed Provisional Application Ser. No. 62/671,878, filed 15 May 2018, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates to a low-profile, lower cost than traditional electronically scanned phased arrays integrated multi-beam cylindrical array that can scan by connecting to one feed or multiple feeds at a time.

BACKGROUND OF THE INVENTION

Typical multibeam antennas, such as phased arrays and multibeam reflectors are bulky and/or highly inefficient. Large visibility can be can be problematic in commercial as well as military systems.

Fixed beam antennas might need to be mechanically or electronically rotated to be able to communicate with various targets at various times.

One of the challenges in the design of planar lenses in the present invention is to achieve a high azimuthal radiation pattern taper for the excitation element. This is important to minimize mutual coupling between excitation ports and spillover in the illumination of the aperture of interest. Since these devices are supposed to operate in a parallel plate and partially dielectric filled environment, the excitation radiation pattern optimization is improved with the present invention. In one embodiment. The proper illumination of the aperture sector of interest may include an increased directivity feed.

Advantages of various embodiments of the invention include an antenna having a low-volume, highly more efficient than traditional electronically scanned phased arrays efficient, with coverage of the entire 360 degrees of azimuth or selected angular sectors. Other advantages include multiple beam functionality (i.e. can communicate with multiple targets in the same time), and coverage of microwave or millimeter wave frequencies over a wide bandwidth. The antenna may track multiple targets while the antenna is mounted on a moving platform. The antenna can be deployed on the bottom of an aircraft to look down for air-to-ground communications or to look up for satellite communication. The invention may further include being a cost effective substitute for a phased array antenna.

SUMMARY OF THE INVENTION

The present invention overcomes the foregoing problems and other shortcomings, drawbacks, and challenges of prior antenna designs. While the invention will be described in connection with certain embodiments, it will be understood that the invention is not limited to these embodiments. To the contrary, this invention includes all alternatives, modifications, and equivalents as may be included within the spirit and scope of the present invention. According to one embodiment of the present invention) we disclose a beamformer including a top flange having a top ramp and annular section. A lens disposed between the top flange and a bottom flange having a feed system to form a directional beam. The beam former feed system may include a director and an exciter. The director may include at least one Yagi Director and the exciter may be a coaxial exciter. In one embodiment the beam former may act as a directional antenna. The bottom flange may include a bottom ramp, a back wall and a feed support section such that the top flange is about one quarter of a wavelength from the bottom flange. The bottom flange may include a bottom ramp, feed support section and a back wall. The beam former may include a bottom flange includes a bottom ramp, a back wall and a feed support section such that the top flange may be about one quarter of a wavelength from the bottom flange.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention. Where characteristics are described as about, the represented variance for intended use, ranges, and/or ratios, is within a range of 10% unless otherwise specified.

Beamforming can be used for radio or sound waves. It has found numerous applications in radar, sonar, seismology, wireless communications, radio astronomy, acoustics and related fields. In one embodiment the beamformer can be an antenna that can be deployed on the bottom of an aircraft to look down for air-to-ground communications or to look up for satellite communication. The beamformer can be used on any platform, especially on small UAVS and can be incorporated in any electronic system requiting azimuth multi-beam functionality.

The present invention is a new concept for a low-profile, low cost integrated multi-beam cylindrical array. It consists of a parallel plate 2D Luneburg beamformer feeding a cylindrical aperture. The invention provides a low profile, low power and low weight multibeam system with 360 degrees of coverage and highly directive excitations. All of which combine to reduce volume, weight and ultimately cost. The device can be used on any platform, especially on small UAVs to provide azimuth multibeam functionality.

Figure 1:
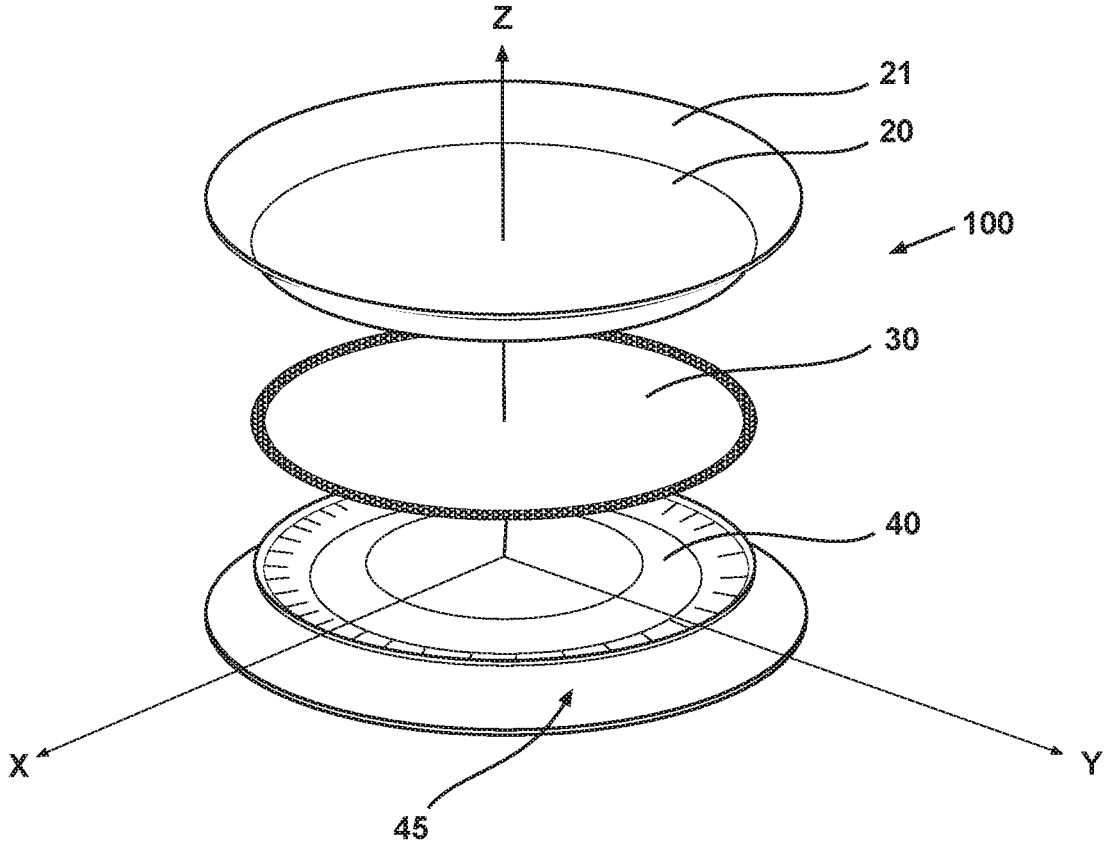
FIG. 1 is an illustration of a 3D exploded view of the Beamformer.
Figure 2:
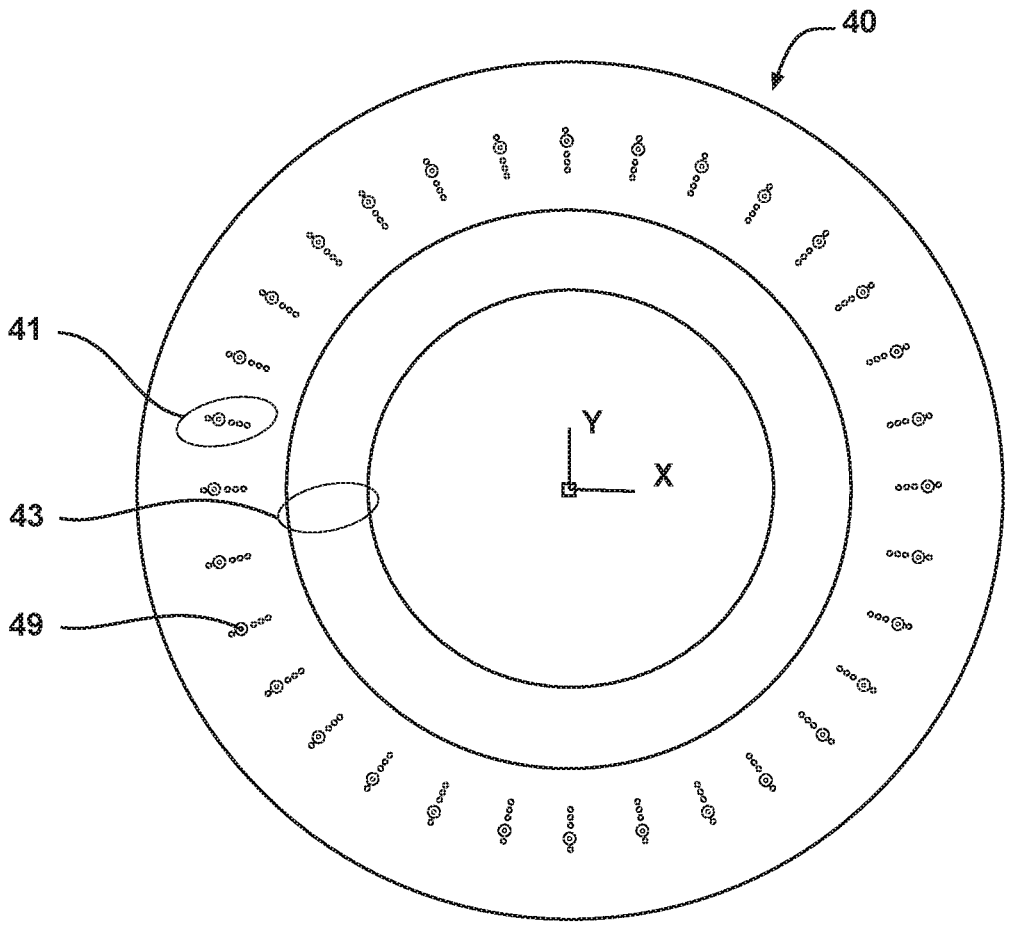
FIG. 2 is an illustration of a Top View of the Bottom Flange.
Figure 3:
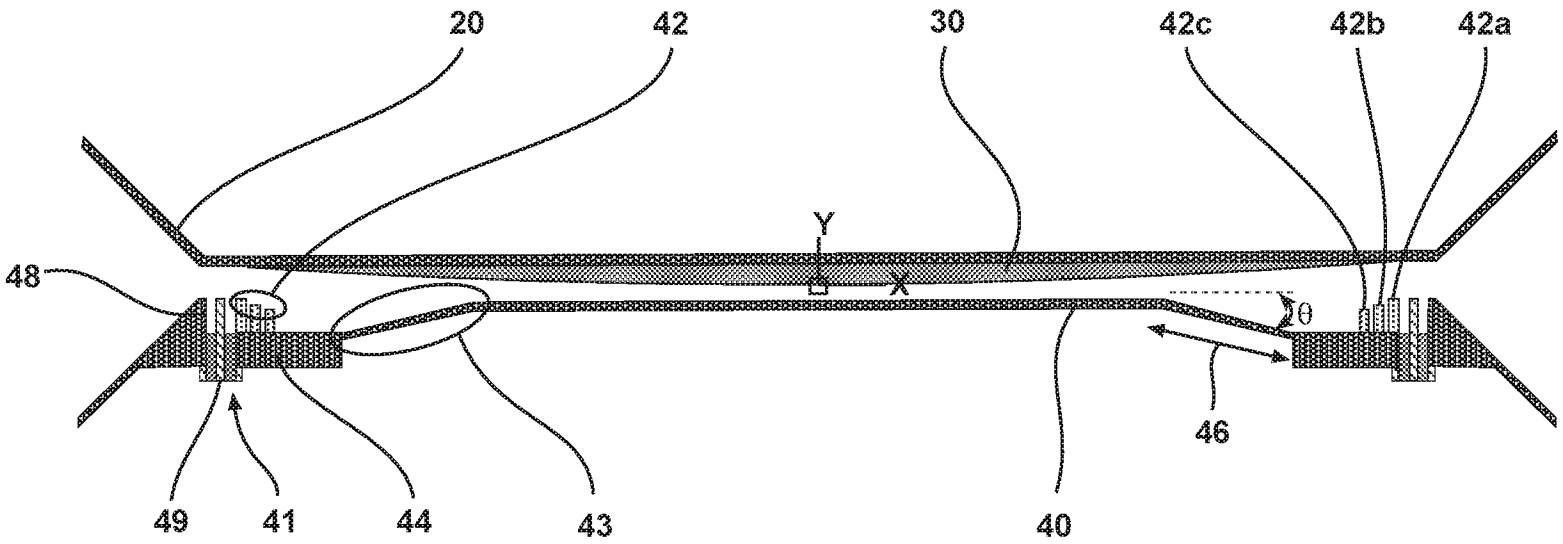
FIG. 3 is an illustration of a cross-section side view of the Beamformer through the feed systems.

The beamformer 100 proposed is illustrated in FIG. 1 with alternate views in FIG. 2, and FIG. 3. FIG. 1 is an expanded (exploded) view of the Beamformer or Multibeam Antenna, which spans a full 360 degree angular sector around in the azimuthal plane, with the azimuth in axis direction Z and the azimuth plane along the X and Y plane. It consists of a parallel plate quasi-Luneburg lens 30 excited by a plurality array of feeds 41 in a bottom flange and oriented in a circular pattern around the axes Z. The lens 30 has a top flange 20 above it and a Bottom Flange 40 below the lens 30 and an optional Bottom Plate 45 which in one embodiment may be integral to the Bottom Flange 40. FIG. 1 shows in one embodiment that the Top Flange 20 may have a Top Ramp 21. FIG. 1 shows a bottom flange 40 under the lens 30.

FIG. 2 is an illustration of the Bottom Flange 40 having a feed system 41 with a plurality of directors 42 arranged in a circle around the axis Z and supported by a Bottom Ramp 43. FIG. 2 show the top view of the Bottom Flange. In one embodiment, the annular section that hosts the fees is located farther from the top flange to reduce the blockage presented for each feed by the other 31 feeds. This feature can be important in achieving low sidelobe performance. As shown in FIG. 2, the plurality of directors 42 is more precisely a plurality of Yagi directors 42.

FIG. 3 is an illustration of a cut away side view of the beamformer 100 showing the bottom flange 40 with the Bottom Ramp 43 to a Feed Support Section 44 supporting Yagi Directors 42 and a Coaxial Exciter between the Yagi Directors 42 and a Back Wall 48. Above the Bottom Flange 40 is Lens 30. Above the lens 30 is the Top Flange 20 having a Top Ramp 21.

The scanning may be achieved using a commutator switch (not shown). The high gain beam may be achieved by the collimation achieved using the lens 30 where there is a parallel plate lens (in the horizontal plane) and by a flared aperture (not shown) in the elevation plane. The side-lobe level in the horizontal plane is controlled by the directivity of the feeds. In one embodiment the feeds are vertical grounded three-element Yagi Directors 42. The cylindrical array of Coaxial Exciters 49 and Yagi Directors 42 may scan by connecting one feed or multiple Feeds Systems 41 the axis Z. As illustrated in FIG. 2 the bottom flange 40 include a plurality of coaxial exciters (feeds) 41. A total of thirty-two (32) feeds 41 are shown in FIG. 2. As shown in FIG. 2, 32 feeds are arranged in a circular array around the axis of the structure. Each feed is a grounded Yagi array which excites a parallel plate wave that propagates through the lens which creates a high gain beam in the diametrically opposed direction.

As shown in FIG. 3, the Top Flange 20 is mostly planar with a flare on the perimeter adding a top ramp 21. The Bottom Flange 40 may be a section spaced about a quarter wavelength away from the Top Flange 20. The bottom flange 40 further may include the bottom ramp 43 and an annular section 22 which hosts the feeds. A lens 30 lies between the top flange 20 and the bottom flange 40 as shown in FIG. 3, the optional bottom plate is not shown in FIG. 3. The flanges may be made of a conductive metal including copper, brass, aluminum or combinations thereof. The flanges may also be made of anon-conductive material such as plastic with a conductive coating.

In one embodiment the bottom ramp 43 length 46 is proportional to about ½ λ, where λ is the speed of light divided by the frequency being selected, or the antenna being designed to detect. As shown in FIG. 3, in one embodiment the ramp slopes downward at an angle θ such that the top of the longest Yagi Director 42 and/or coaxial exciter 49 extends from the feed support section to about level with the bottom flange 40. Preferably the Yagi Directors very in height with the Yagi director nearest the nearest coaxial exciter longer or taller than the remaining Yagi directors near or associated with a particular coaxial exciter. Each Yagi director 42 may have a different height and in one embodiment get shorter as they extend away from the related coaxial exciter. As shown in FIG. 3. Yagi director 42*a* is nearest the coaxial exciter and tallest in height, in one embodiment about equal with respect to the coaxial exciter and about level with the bottom flange 40. Yagi director 42*b* is further from the associated coaxial exciter (nearest one), but closer than the Yagi director 42*c*. In one embodiment and as shown in FIG. 3 Yagi director 42*b* is shorter than Yagi director 42*a* but shorter than Yagi director 42*c*, both of which are below level with the bottom flange 40.

In some embodiments, the feed system 41 may be grounded-Yagi antenna elements Yagi Directors 42. In some embodiments, one or more of the plurality of feed elements systems 41 may illuminate at least a portion of the top flange 20, the bottom flange 40 and the lens 30 generating a high gain radiation pattern on the opposite direction of the device.

In some embodiments, the antenna includes a switching matrix in that allows the selection of one or more feeds to be excited and produce one or multiple simultaneous beams.

In some embodiments, the circular-shaped lens can receives and or transmit electromagnetic energy and focuses at least a portion of the received electromagnetic energy to one or more of the plurality of feed elements.

The illustration in FIG. 3 is a side sectional illustration of a cross-section side view of the Beamformer 100 between the feed systems 41 illustrating the bottom flange 40, the bottom ramp 43 and the feed support section 44 and a back wall 48.

The feed system 41 may be a Yagi feed System as shown in FIG. 3. The Yagi feed illustrated includes a coaxial exciter 43, three Yagi directors 42 and a back wall 48, the back wall provided by the Bottom Flange 40. In one embodiment the invention may include a parallel plate quasi-Luneburg lens excited by the circular array of feed systems 41. In one embodiment the scanning is achieved using a low loss commutator switch.

In one embodiment the Yagi Directors 42 extend with a height from the feed support section by varying lengths, where height is measured in the Y direction in FIG. 3. In one embodiment the Yagi Director 42*a* nearest the nearest coaxial exciter 49 with a height extends to about even with the bottom flange 40 in the Y direction of FIG. 3. The Yagi director 42*b* second furthest from the nearest coaxial exciter

49 has a height shorter than the Yagi Director 42*a*, but longer than the height of Yagi Director 42*c*. In one embodiment the change in Yagi Director height is a function of the frequency, the angle θ or a combination there of. In one embodiment the back wall 48 has a height relative to the feed support section 44 in the Y direction about equal to the height of the coaxial exciter 49 relative to the feed support section 44.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A beam former comprising:

a top flange having a top ramp and annular section;

a lens disposed between the top flange and;

a bottom flange having a feed system to form a directional beam; wherein the feed system includes a plurality of directors and a plurality of exciters spaced around the lens.

2. The beam former of claim 1 wherein the directors are three Yagi Directors, each with a different height and the exciter is a coaxial exciter.

3. The beam former of claim 2 wherein a Yagi Director nearest a nearest coaxial exciter with a Yagi Director height extends the Yagi Director height to about even with the bottom flange in a Y direction.

4. The beam former of claim 3 wherein the remaining Yagi Directors have a height shorter than the Yagi Director nearest the nearest coaxial exciter.

5. The beam former of claim 2 wherein the beam former is a directional antenna.

6. The beam former of claim 2 wherein the bottom flange includes a bottom ramp, feed support section and a back wall.

7. The beam former of claim 6 wherein the bottom ramp slopes downward at an angle θ such that the longest Yagi director and the coaxial exciter extend from the feed support section to about level with the bottom flange.

8. The beam former of claim 7 wherein the back wall extends from the feed support section to about level with the bottom flange.

9. The beam former of claim 8 wherein the top flange is about one quarter of a wavelength of a frequency being detected, from the bottom flange.

10. The beam former of claim 9 wherein the bottom ramp has a length proportional to about ½ λ, where λ is the speed of light divided by the frequency being detected.

11. The beam former of claim 10 wherein the ramp slopes downward at an angle θ such that the height of the longest Yagi Director and the coaxial exciter is about level with the bottom flange.

12. The beam former of claim 11 wherein the back wall has a height relative to the feed support section about equal to the height of the coaxial exciter.

13. The beam former of claim 1 wherein the bottom flange includes a bottom ramp, a back wall and a feed support section such that the top flange is about one quarter of a wavelength from the bottom flange.

* * * * *